US006808299B2

(12) United States Patent
Wijbenga et al.

(10) Patent No.: US 6,808,299 B2
(45) Date of Patent: Oct. 26, 2004

(54) LUMINAIRE

(75) Inventors: Hendrik Wijbenga, Eindhoven (NL); Jean Entrop, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/101,787

(22) Filed: Mar. 20, 2002

(65) Prior Publication Data

US 2002/0136011 A1 Sep. 26, 2002

(30) Foreign Application Priority Data

Mar. 23, 2001 (EP) ..... 01201098

(51) Int. Cl.[7] ..... F21V 7/00

(52) U.S. Cl. ..... 362/516; 362/247; 362/241; 362/296; 362/341; 362/212; 362/218; 362/214; 359/839; 359/884

(58) Field of Search ..... 362/516, 247, 362/241, 296, 341, 297, 346, 347, 349; 359/839, 884, 212, 218, 214

(56) References Cited

U.S. PATENT DOCUMENTS 3,588,492 A * 6/1971 Pollock ..... 362/309
4,229,779 A * 10/1980 Bilson et al. ..... 362/217
4,748,543 A * 5/1988 Swarens ..... 362/147
6,036,338 A 3/2000 Gordin ..... 362/350
6,190,028 B1 * 2/2001 Aikawa et al. ..... 362/510
6,575,602 B2 * 6/2003 Sools et al. ..... 362/343

OTHER PUBLICATIONS

Pending Patent Application in USPTO, Our Docket No. NL 000190, Ser. No. 09/824619, Entitled: Luminaire, Inventor R.G.P. Sools.

* cited by examiner

*Primary Examiner*—Stephen Husar
*Assistant Examiner*—Bertrand Zeade

(57) ABSTRACT

The luminaire comprises a reflector body (1) which has a reflecting coating (2) on its reflection side (3), and means (4) for accommodating an electric lamp on the reflection side (3). The reflection side (3) has an area (31) with a metal reflecting surface. The area (31) may have a metal sheet cover (32). The cover (32) may follow the surface of the area (31), or it may be spaced apart therefrom. The luminaire benefits from the low absorption of light by the coating (2), and from the high specular reflection of metal in the area (31) to give a high light intensity in a direction determined by the position of the area (31) with respect to a lamp accommodated by the means (4).

10 Claims, 3 Drawing Sheets

LUMINAIRE

The invention relates to a luminaire comprising:

a reflector body which has a reflecting coating on its concave reflection side, which coating has a diffuse reflection component and a specular reflection component, and means for accommodating an electric lamp on the reflection side.

Such a luminaire is described in the non-prepublished European Patent Application 00 201 209.4 (PH-NL000190).

The use of a reflective coating on a reflector body is attractive, because the reflecting surface then has a much higher reflection coefficient and thus a lower absorption than a metal, for example, aluminum reflector body.

In the described luminaire, the coating has a relatively high specular reflection component along with a relatively low diffuse reflection component. In this way, the luminaire described combines the advantage of a low absorption of incident light with a considerably high level of specular reflection of incident light. Consequently, the luminaire can achieve a high efficiency, that is to say, a high quantity of irradiated light as a percentage of the light generated by an accommodated lamp, which is accompanied by a substantially high concentration of the irradiated light.

However, the described luminaire has the drawback that, as a result of the diffuse reflection component of the coating, an area of the reflection side of the reflector body does not radiate as much light in a direction determined by the position of this area with respect to the lamp as would have been the case with a reflector body with a specular reflection side. The light intensity of the beam of light generated by the luminaire may then be too low in said direction in order to provide a sufficient light intensity in said direction.

It is an object of the invention to provide a luminaire of the type described in the opening paragraph, which, in operation of an accommodated electric lamp, has a relatively high light intensity in a chosen direction.

According to the invention, this object is achieved in that the reflection side has an area with a metal reflecting surface.

The light incident on the area, generated by the accommodated lamp, is reflected by that area at least substantially in a specular manner. As a result, it is specifically reflected in the direction determined by this area. The section of the field to be illuminated in said direction then acquires a relatively high light intensity.

By applying the coating, the area can be screened off so that it is not covered by coating. It is also possible to remove coating from the area, for example before the coating has hardened.

However, in an embodiment which can be easily realized, the area has a metal sheet cover. This embodiment has various advantages. Not only can the entire reflection side of the reflector body be provided with the coating, without this having to be removed in part, but the reflector body can also be made from an optically low-value material such as plastic or cast aluminum. The reflection side does not need to have a high-value surface either, such as a polished or an eloxated surface. Only the metal sheet needs to be made of an optically high-value metal, generally used for, for example, reflectors, for example, high-polish aluminum or semi-high-polish aluminum.

The metal sheet may be secured to the reflector body by means of, for example, glue. Alternatively, it may be secured mechanically, for example with tongues on the sheet that protrude through apertures in the reflector body and are bent or twisted behind the reflector body.

The metal sheet can essentially fully follow the surface of the area which it covers. If the area has, for example, a facetted structure, the metal sheet itself has the same structure and almost completely engages the reflector body.

In a variant of this embodiment, the metal sheet cover is positioned at least partly remote from the area. This variant has the advantage that, with a reflector body of a given basic shape, a variety of reflectors can be realized so that the reflector body can be optimized for a selected purpose.

It is advantageous if the reflecting coating has a surface remote from the reflector body and comprises a light-transmissive binder in which light-reflecting particles are dispersed, the surface remote from the reflector body being substantially free from light-reflecting particles. The surface remote from the reflector body is then smooth and has a high level of specular reflection. Furthermore, the smooth surface prevents contamination by dust to a large extent.

It is advantageous for a high level of specular reflection if the coating comprises not more than 75% by volume of light-reflecting particles.

The coating may have a first layer comprising a light-transmissive binder in which light-reflecting particles are dispersed, and a second layer being substantially free from light-reflecting particles on a surface remote from the reflector body.

The light-reflecting particles may be surrounded by a pigment skin. In this way, a further increase of the specular reflection component is achieved, in particular if the particles and the pigment skin have different refractive indices.

It is advantageous if the light-reflecting particles are chosen from halophosphates, calcium pyrophosphate, strontium pyrophosphate and titanium dioxide.

The light-transmissive binder may comprise a silicon binder.

The luminaire may have a housing in which the reflector body is accommodated. The housing may be closed by means of a window pane which covers a light exit window of the reflector body.

The luminaire may be suitable for accommodating a halogen incandescent lamp, such as a tubular halogen incandescent lamp. The luminaire may alternatively be intended for use with a high-pressure discharge lamp, such as a high-pressure sodium discharge lamp, or a high-pressure metal halide discharge lamp, for example, with a quartz glass or a ceramic discharge vessel, such as, for example, an aluminum oxide discharge vessel.

The reflector body may be divided, for example in a plane, by the means to accommodate a lamp. Such a division may simplify exchanging of a lamp. The luminaire may be suitable for a range of applications, such as sports field floodlighting, tunnel lighting, site floodlighting, canopy lighting at petrol stations, etc.

Embodiments of the luminaire according to the invention are shown in the drawings. In these drawings, FIG. 1 shows a first embodiment in a longitudinal section in a plane of symmetry;

Figure 1:
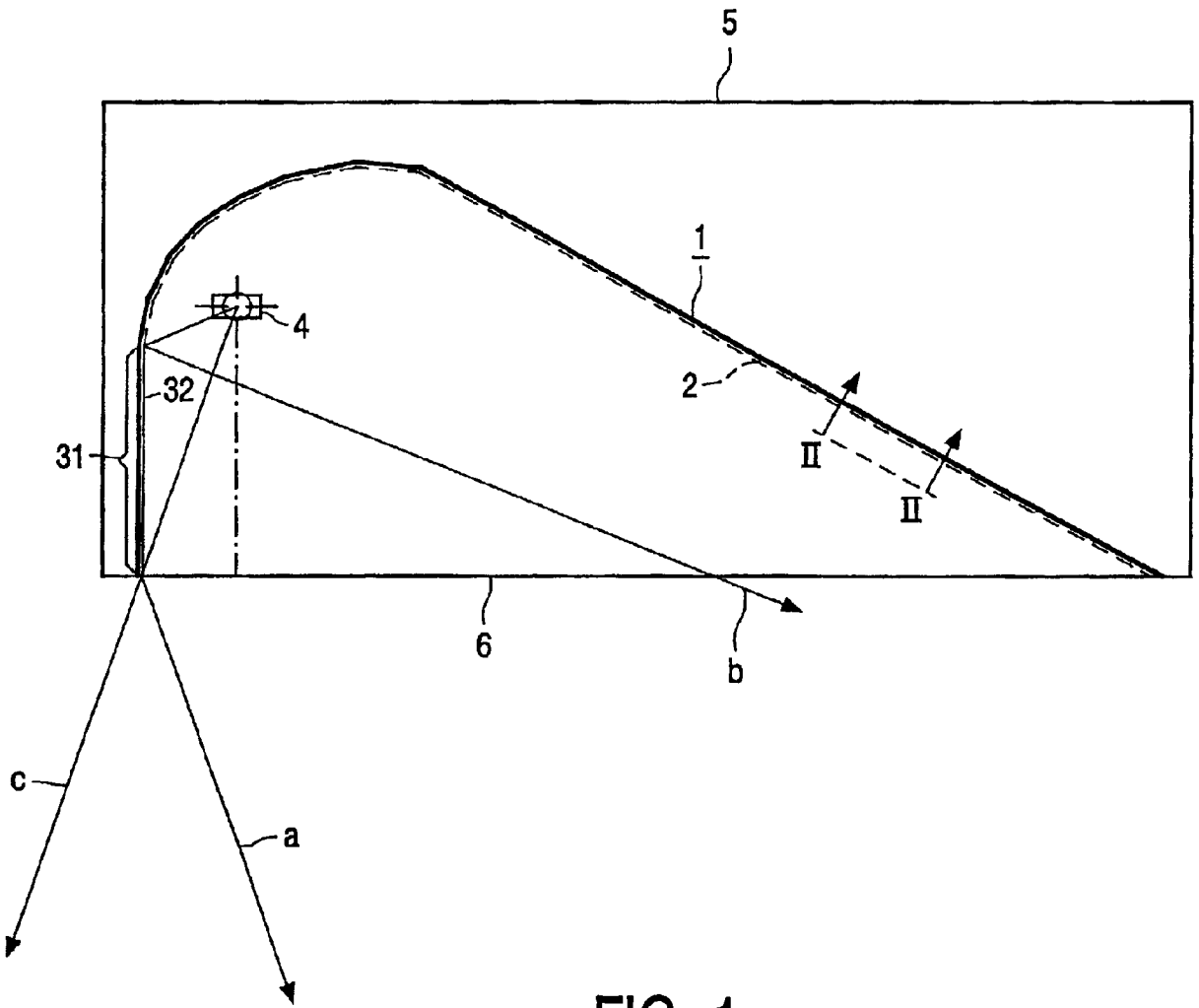
Figure 2:
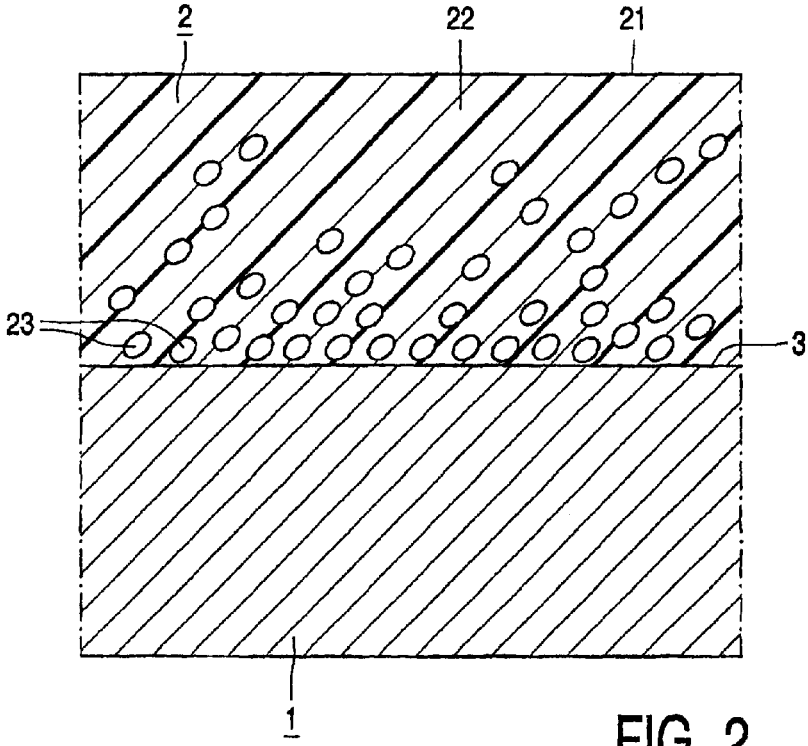
FIG. 2 is a cross-section through the reflector body, taken on the line II—II in FIG. 1.

The luminaire of FIGS. 1 and 2 comprises a reflector body 1 having a reflecting coating 2 on its concave reflection side 3, which coating 2 has a diffuse reflection component and a specular reflection component. Means 4 are present for accommodating an electric lamp on the reflection side 3.

The reflection side 3 has an area 31 with a metal reflecting surface. The reflector body 1 is accommodated in a housing 5 and has a light exit window 6.

The reflector body 1 is asymmetrical in shape, so that the luminaire can be used, for example, for site lighting or tunnel lighting. The light rays a and b that originate from the center line of an electric lamp accommodated by the means 4, undergo specular reflection by the metal surface of the area 31. When the luminaire is used for tunnel lighting, wherein the luminaire is mounted on the roof of the tunnel, with the light exit window 6 horizontal and directed downwards, the rays a and b travel against the traffic direction, so that the road surface achieves a high luminance for the traffic. Due to its geometry, the reflector body 1 itself screens all the light that might exit at an angle of 10° and less to the horizontal. This prevents dazzle. The light beams a and b and the beams traveling between them in a targeted direction determined by the metal surface of the area 31 illuminate part of the road, which without the metal surface would receive too little light and would therefore have too little luminance.

Ray of light c originates from the center line of the lamp and just misses the reflector body 1, so that the ray can exit directly. The housing 5 may be sealed by means of a window pane.

In FIG. 1, the area 31 has a metal sheet cover 32, namely of semi-high-polished aluminum.

The reflecting coating 2 has a surface 21 remote from the reflector body, see FIG. 2, and comprises a light-transmissive binder 22 in which light-reflecting particles 23 are dispersed. The surface 21 remote from the reflector body is substantially free from light-reflecting particles 23.

The coating 2 comprises not more than 75% by volume of light-reflecting particles 23, in the Figure approximately 25% by volume of $TiO_2$, in silicon binder 22.

The coating has a reflection coefficient of approximately 97%, wherein the specular proportion of the reflection is approximately 20% upon perpendicular incidence of radiation. At a grazing incidence, the specular reflection is even higher. The aluminum sheet has a reflection coefficient of approximately 92%.

Figure 4:
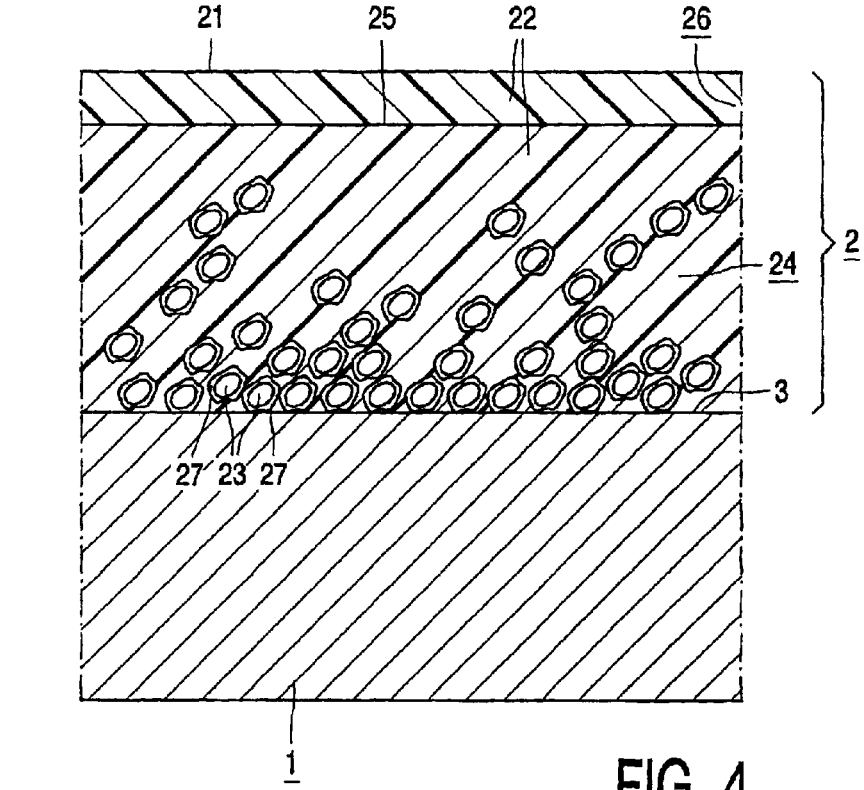
FIG. 4 is a cross-section through the reflector body, taken on the line IV—IV in FIG. 3.
Figure 3:
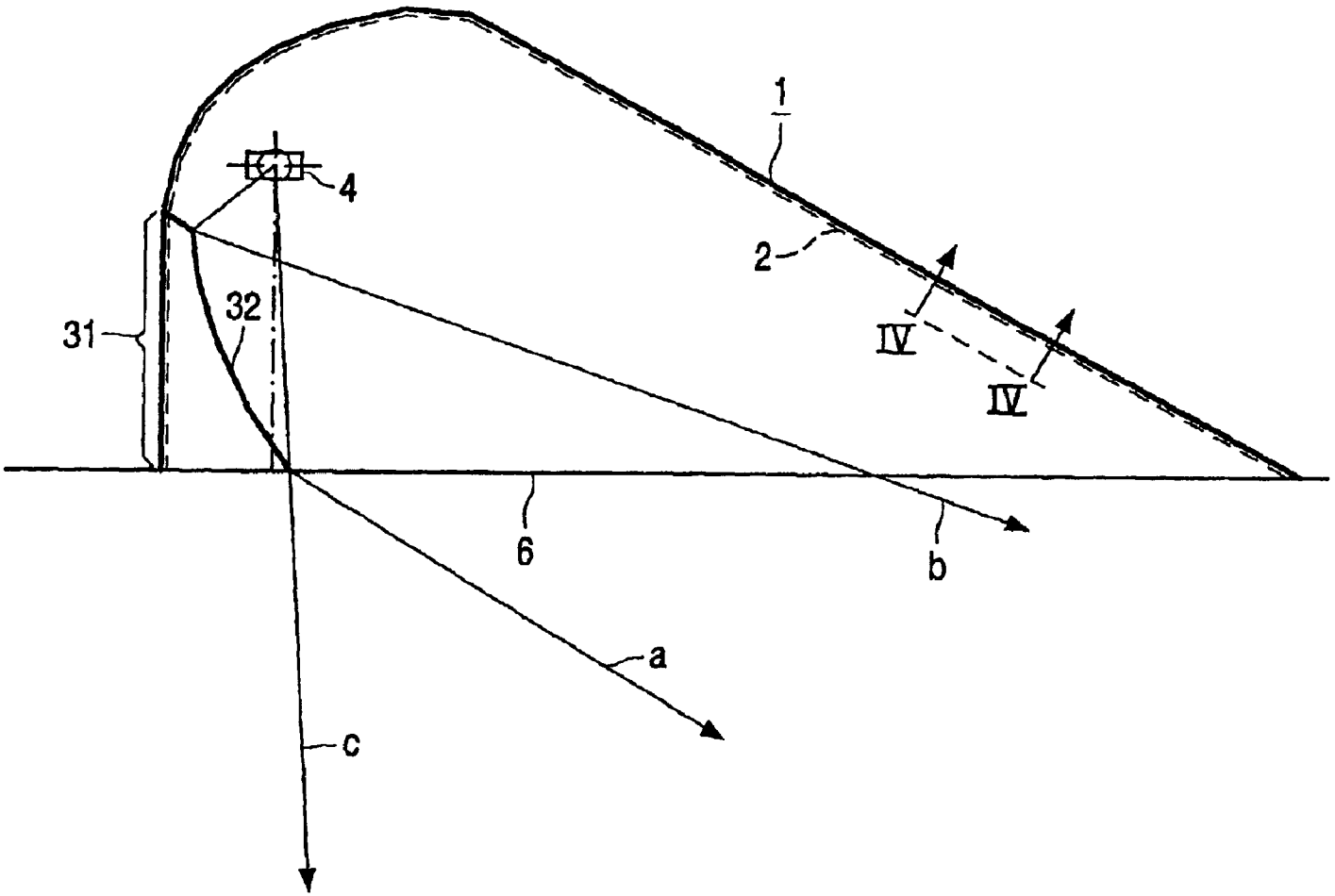
FIG. 3 shows a second embodiment in a longitudinal section in a plane of symmetry.

In FIGS. 3 and 4, reference numerals denote the same components as in FIGS. 1 and 2.

In FIG. 3 the reflector body 1 has the same shape as in FIG. 1. The cover 32 is at least partly remote from the area 31 and thus has a different position, but in the Figure also a different shape than the area 31. The Figure shows that the coating 2, indicated by the broken line, is present throughout the reflection side 3 of the reflector body.

Due to the shape of the cover 32, which deviates from the shape of the reflector body 1 at the area 31, the rays a and b in FIG. 3 are reflected differently, at smaller angles to the horizontal than in FIG. 1. A section of the area at a relatively large distance from the luminaire is thereby illuminated more intensely. Another consequence is that the ray c, which comes from the center line of an accommodated lamp and leaves the luminaire just without reflection, falls forwards along with the beam of light formed, and not perpendicularly downwards from the lamp, or even backwards, as in FIG. 1. Said area section is illuminated more intensely, while it is relatively dark below and behind the luminaire.

The coating 2, see FIG. 4, has a first layer 24 comprising a light-transmissive binder 22 in which light-reflecting particles 23 are dispersed. A surface 25 remote from the reflector body is provided with a second layer 26 which is substantially free from light-reflecting particles 23.

The light-reflecting particles 23 are surrounded by a pigment skin 27. The particles 23 and the pigment skin 27 have different refractive indices.

The light-reflecting particles 23 are chosen from halophosphates, calcium pyrophosphate, strontium pyrophosphate and titanium dioxide. In the Figure, they comprise $TiO_2$, refractive index approx. 2.32, and are surrounded by an aluminum oxide skin, refractive index approximately 1.63.

The light-transmissive binder 22 is a silicon binder.

The coatings were applied on the entire reflection side as a dispersion in cyclohexane. The coatings were dried for approximately 45 minutes at a temperature of approximately 130° C. in air. This made the particles 23 and 23, 27 bulge. The reflector body 1 of FIG. 3 was subsequently given a second layer 26 by providing silicon binder in cyclohexane.

What is claimed is:

1. A luminaire generating relatively high light intensity in a chosen direction, comprising:

a light exit window (6);

a reflector body (1) having an asymmetrical shape and positioned opposite the light exit window (6), said reflector body (1) screens all light that extends at an angle of 10 degrees or less to the horizontal, said reflector body (1) further having a reflecting coating (2) on its concave reflection side (3), which coating (2) has a diffuse reflection component and a specular reflection component; and means (4) for accommodating an electric lamp on the reflection side (3), wherein the reflection side (3) has an area (31) overlaid with a metallic member (32) having a metal reflecting surface, the metal reflecting surface allowing light rays originating from a center line of the electric lamp to undergo specular reflection thereby generating high light intensity in a chosen direction.

2. A luminaire as claimed in claim 1, wherein the metallic member (32) is a metal sheet cover (32).

3. A luminaire as claimed in claim 2, wherein the metal sheet cover (32) is at least partly remote from the area (31).

4. A luminaire as claimed in claim 1, wherein the reflecting coating (2) has a surface (21) remote from the reflector body and comprises a light-transmissive binder (22) in which light-reflecting particles (23) are dispersed, the surface (21) remote from the reflector body being substantially free from light-reflecting particles (23).

5. A luminaire as claimed in claim 4, wherein the coating (2) comprises not more than 75% by volume of light-reflecting particles (23).

6. A luminaire as claimed in claim 5, wherein the coating (2) has a first layer (24) comprising a light-transmissive binder (22) in which light-reflecting particles (23) are dispersed, and a second layer (26) being substantially free from light-reflecting particles (23) on a surface (25) remote from the reflector body.

7. A luminaire as claimed in claim 5, wherein the light-reflecting particles (23) are surrounded by a pigment skin (27).

8. A luminaire as claimed in claim 7, wherein the particles (23) and the pigment skin (27) have different refractive indices.

9. A luminaire as claimed in claim 4, wherein the light-reflecting particles (23) are chosen from halophosphates, calcium pyrophosphate, strontium pyrophosphate and titanium dioxide.

10. A luminaire as claimed in claim 4, wherein the light-transmissive binder (22) comprises a silicon binder.

* * * * *